US011804658B2

(12) United States Patent
Lu et al.

(10) Patent No.: US 11,804,658 B2
(45) Date of Patent: Oct. 31, 2023

(54) MITIGATION OF POLARIZATION MISMATCH BETWEEN REFLECTOR AND FEED ANTENNAS BY FEED PREDISTORTION

(71) Applicant: HUGHES NETWORK SYSTEMS, LLC, Germantown, MD (US)

(72) Inventors: Bingqian Lu, Germantown, MD (US); Hamad Alsawaha, Germantown, MD (US); Peter Hou, Germantown, MD (US); Thomas Jackson, Germantown, MD (US)

(73) Assignee: Hughes Network Systems, LLC, Germantown, MD (US)

( * ) Notice: Subject to any disclaimer, the term of this patent is extended or adjusted under 35 U.S.C. 154(b) by 426 days.

(21) Appl. No.: 16/186,088

(22) Filed: Nov. 9, 2018

(65) Prior Publication Data

US 2020/0153105 A1 May 14, 2020

(51) Int. Cl.

| | |
|---|---|
| ***H01Q 15/24*** | (2006.01) |
| ***H01Q 19/02*** | (2006.01) |
| ***H01Q 13/02*** | (2006.01) |
| ***H01Q 19/195*** | (2006.01) |
| ***H01Q 25/00*** | (2006.01) |

(52) U.S. Cl.

CPC ..... *H01Q 15/24* (2013.01); *H01Q 13/025* (2013.01); *H01Q 13/0208* (2013.01); *H01Q 19/021* (2013.01); *H01Q 19/195* (2013.01); *H01Q 25/001* (2013.01)

(58) Field of Classification Search

CPC ..... H01Q 13/04; H01Q 15/14–22; H01Q 19/10–195; H01Q 19/08

See application file for complete search history.

(56) References Cited

U.S. PATENT DOCUMENTS 3,230,537 A * 1/1966 Bartholoma ..... H01Q 19/13 343/756

3,453,633 A * 7/1969 Phillips ..... G01S 7/4811 343/912

(Continued)

FOREIGN PATENT DOCUMENTS

WO 15161718 A1 10/2015

OTHER PUBLICATIONS

International Search Report and Written Opinion issued in International Application No. PCT/US2019/059747, dated Jan. 15, 2020.

*Primary Examiner* — Ab Salam Alkassim, Jr.

(74) *Attorney, Agent, or Firm* — Potomac Technology Law, LLC

(57) ABSTRACT

An apparatus and method for mitigating polarization mismatch in reflector antenna systems. A feed unit is configured to determine a polarization mismatch between a first polarization associated with a first wave and a second polarization associated with a reflector unit. The feed unit pre-distorts the first wave to achieve a compensated polarization for reducing and/or eliminating a polarization mismatch. The pre-distorted first wave having the compensated polarization is used to illuminate the reflector unit. A re-radiated wave is reflected by the reflector unit. Furthermore, the level of the re-radiated wave is increased as a result of the pre-distortion.

6 Claims, 14 Drawing Sheets

(56) References Cited

U.S. PATENT DOCUMENTS 3,622,884 A * 11/1971 Kent ..... H01Q 21/24 455/81
3,775,769 A * 11/1973 Heeren ..... H01Q 3/46 343/754
4,109,253 A * 8/1978 Chu ..... H01Q 19/195 343/756
4,144,535 A * 3/1979 Dragone ..... H01Q 19/028 343/756
4,398,200 A * 8/1983 Meier ..... H01Q 19/028 343/756
4,523,160 A 6/1985 Pioussios
4,982,198 A * 1/1991 Shafai ..... H01Q 19/193 343/818
6,323,819 B1 * 11/2001 Ergene ..... H01Q 13/0241 343/786
8,077,103 B1 12/2011 Acosta et al.
8,289,221 B1 * 10/2012 Finucane ..... H01Q 1/08 343/781 R
9,939,585 B1 * 4/2018 Monte ..... H01P 1/17
10,218,076 B1 * 2/2019 Bhardwaj ..... H01Q 13/0241
2003/0025641 A1 * 2/2003 Tits ..... H01Q 13/0208 343/840
2005/0237266 A1 10/2005 Durham et al.
2007/0296641 A1 * 12/2007 Cook ..... H01Q 13/02 343/786
2009/0109111 A1 * 4/2009 McGonigle ..... H01Q 13/0208 343/786
2012/0162010 A1 * 6/2012 Georgiadis ..... E02D 29/14 342/368
2013/0099990 A1 4/2013 Bresciani et al.
2013/0187830 A1 7/2013 Warnick et al.
2015/0097747 A1 * 4/2015 Hwang ..... H01Q 5/47 343/785
2015/0381265 A1 * 12/2015 Runyon ..... H01Q 1/288 455/13.3
2017/0207541 A1 * 7/2017 Wu ..... H01Q 5/55
2018/0026365 A1 * 1/2018 Driscoll ..... H01Q 3/26 342/379
2018/0026686 A1 * 1/2018 Gerdin ..... H04B 17/12 455/63.4
2019/0025422 A1 * 1/2019 Edinger ..... B64G 1/1021
2021/0305707 A1 * 9/2021 Gimersky ..... H01Q 13/0258
2022/0037793 A1 * 2/2022 Hou ..... H01Q 15/244

* cited by examiner

MITIGATION OF POLARIZATION MISMATCH BETWEEN REFLECTOR AND FEED ANTENNAS BY FEED PREDISTORTION

BACKGROUND INFORMATION

Reflector antenna systems are widely used for a variety of modern applications. For example, reflector antenna systems are used in radio astronomy, satellite, remote-sensing, and telecommunication applications. Reflector antenna systems have various features that have contributed to their increased use including planar geometry, low mechanical complexity, and lack of a complex feeding network. The surface of traditional reflector units consists of isolated radiating elements that are illuminated by a feed unit. The radiating elements are pre-designed with a particular phase delay to re-radiate and scatter the incident wave to generate a desired wavefront.

Reflector antenna systems typically use a feed unit to illuminate the surface of the reflector unit with a signal that is center fed or offset fed. The feed unit can be configured to apply a predetermined polarization to the signal prior to illuminating the surface of the reflector unit. Depending on the configuration, for example, the signal can be Left Hand Circular Polarization (LHCP), Right Hand Circular Polarization (RHCP), etc. Additionally, the reflector unit can be configured to provide the same polarization as the feed unit. Thus, a feed unit providing LHCP would be matched with a reflector unit configured to provide LHCP.

Reflector units are typically designed to minimize cross-polarization. Once the reflector antenna system is deployed, however, its efficiency is established and further adjustments are typically not made. This can result in various disadvantages in system performance. Center-fed reflector antenna systems can create a shadow effect on the reflector unit and consequently reduce the being power received. While offset-fed systems are generally preferred over center-fed systems, the offset angle at which the feed unit is positioned can create a design difficulty because cross-polarization is more pronounced when the reflector unit is illuminated from an oblique incident angle. Consequently, the desired polarization is distorted and becomes different from the feed unit polarization, thus creating polarization mismatch.

Electronically beam-scanning reflectarray antenna systems can be used to address some polarization mismatch. The reflector unit of the electronically beam-scanning reflectarray antenna system is designed to provide the best polarization achievable for a desired theoretical polarization, such as LHCP, RHCP, linear polarization (LP) along the X-axis and LP along the Y-axis. Electronically beam-scanning reflectarray antenna systems often incorporate an offset feed unit in order to increase the overall antenna efficiency and increase gain by avoiding shadow effects. Such reflector units have the best axial ratio at the boresight, and degraded cross-polarization as the angle of the incident wave is increased. Once deployed, however, adjustments are not made to the reflector antenna system to address the resulting polarization mismatch. Thus, polarization mismatch will persist unless the reflector unit is replaced and/or reconfigured. Based on the foregoing, there is a need for an approach to reduce or eliminate polarization mismatch in reflector antenna systems.

BRIEF SUMMARY

An apparatus and method are disclosed for mitigating polarization mismatch in reflector antenna systems. According to an embodiment, the apparatus includes a feed unit configured to: generate a first wave having a first polarization, determine a polarization mismatch between the first polarization and a second polarization, and pre-distort the first wave to achieve a compensated polarization for reducing and/or eliminating a polarization mismatch, and output the pre-distorted first wave having the compensated polarization; and a reflector unit for receiving the pre-distorted first wave and reflecting at least a re-radiated wave, wherein the second polarization is associated with the reflector unit, and wherein a level of the re-radiated wave is increased as a result of the pre-distortion.

According to another embodiment, the method includes configuring a feed unit of a reflector antenna system to generate a first wave having a first polarization; determining a polarization mismatch between the first polarization and a second polarization associated with a reflector unit of the reflector antenna system; pre-distorting the first wave to achieve a compensated polarization for reducing and/or eliminating the polarization mismatch; illuminating the reflector unit with the pre-distorted first wave having the compensated polarization; and reflecting, by the reflector unit, at least a re-radiated wave, wherein a level of the re-radiated wave is increased as a result of the pre-distortion.

The foregoing summary is only intended to provide a brief introduction to selected features that are described in greater detail below in the detailed description. As such, this summary is not intended to identify, represent, or highlight features believed to be key or essential to the claimed subject matter. Furthermore, this summary is not intended to be used as an aid in determining the scope of the claimed subject matter.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DETAILED DESCRIPTION

An apparatus and method for mitigating polarization mismatch in reflector antenna systems are described. In the following description, for purposes of explanation, numerous specific details are set forth in order to provide a thorough understanding of the disclosed embodiments. It will become apparent, however, to one skilled in the art that various embodiments may be practiced without these specific details or with an equivalent arrangement. In other instances, well-known structures and devices are shown in block diagram form in order to avoid unnecessarily obscuring the various embodiments.

Figure 1A:
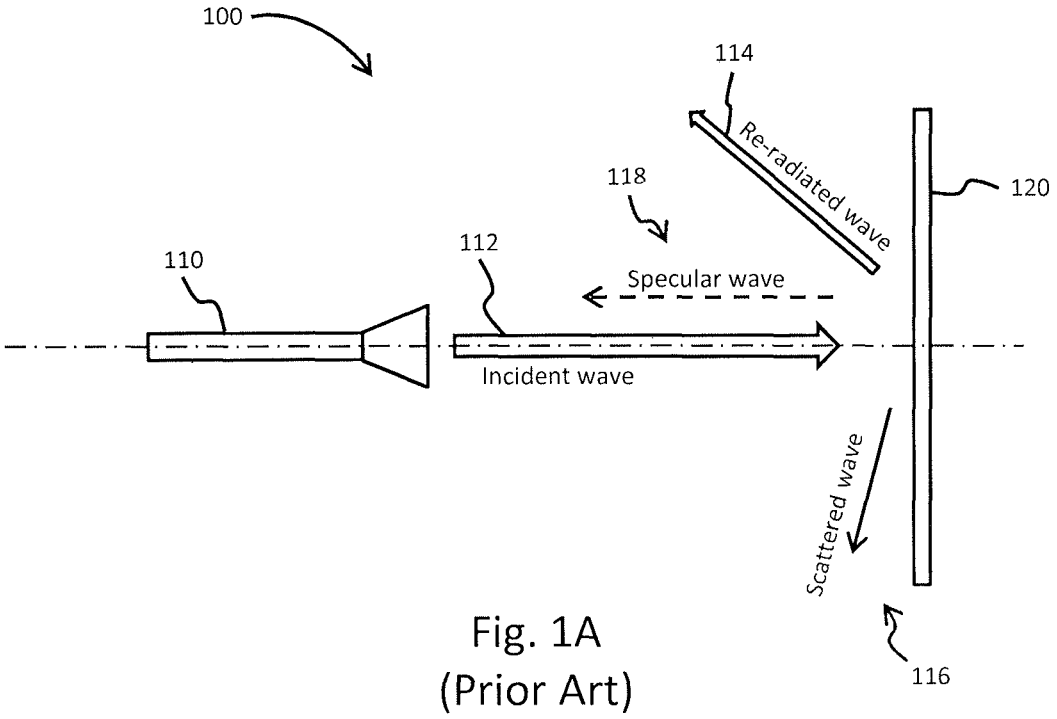
Fig. 1A (Prior Art)
FIG. 1A is a diagram of a conventional reflector antenna system.

FIG. 1A is a diagram of a conventional reflector antenna system 100. The reflector antenna system 100 includes a feed unit 110 and a reflector unit 120. As illustrated in FIG. 1A, the feed unit 110 is oriented to direct an incident wave 112 along a centerline of the reflector unit 120. More particularly, the reflector antenna system 100 is configured as a center-fed reflector antenna system. The feed unit 110 directs the incident wave 112 to illuminate the surface of the reflector unit 120. Depending on properties such as phase delay lines, patch size, etc., the incident wave 112 is reflected from the reflector unit 120 in several components, namely a re-radiated wave 114, a scattered wave 116, and a specular wave 118.

The re-radiated wave 114 corresponds to the desired component of the total reflection. The re-radiated wave 114 results from resonant activity of elements of the reflector unit 120 and has $E_x$ and $E_y$ components that define an axial ratio which characterizes its polarization. A polarization mismatch is created when the polarization of the re-radiated wave 114 differs from the polarization of the incident wave 112. The scattered wave 116 corresponds to a non-resonant component of the total reflection which results from the physical structure of the reflector element 120. The specular wave 118 is an inevitable component of the total reflection which results from the ground plane of the reflector unit 120.

Figure 1B:
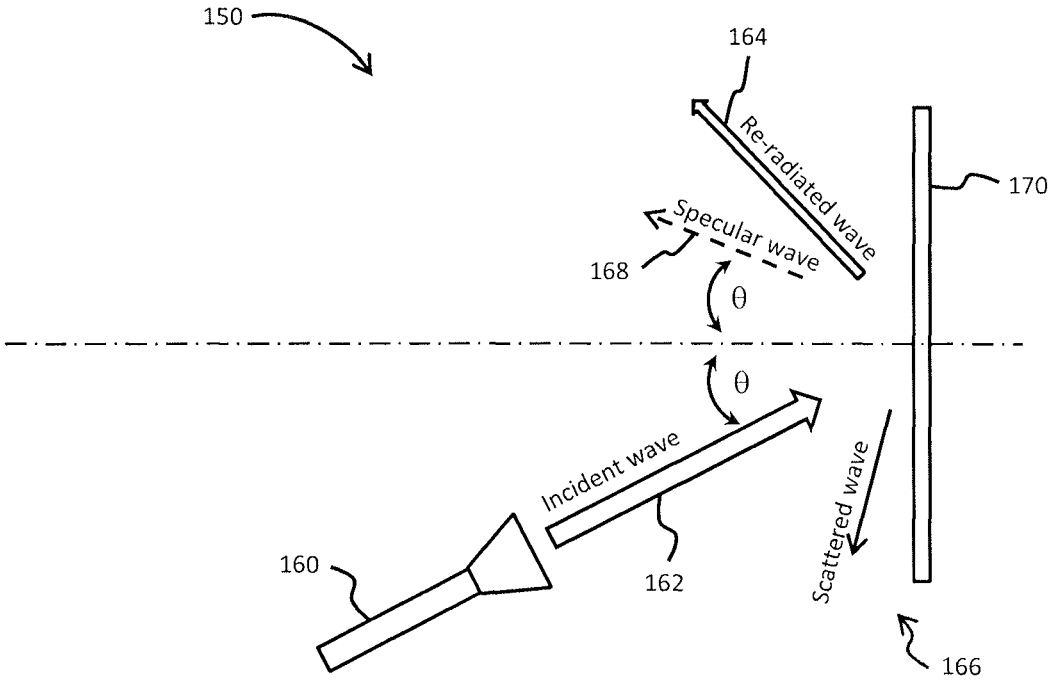
Fig. 1B (Prior Art)
FIG. 1B is a diagram of another second conventional reflector antenna system.

FIG. 1B is a diagram of an alternative configuration for a reflector antenna system 150. The reflector antenna system 150 is configured as an offset-fed reflector antenna system. As illustrated in FIG. 1B, a feed unit 160 is provided at an offset angle θ relative to the centerline of the reflector unit 170. The feed unit 160 directs an incident wave 162 to illuminate the surface of the reflector unit 170. Similar to the center-fed reflector antenna system of FIG. 1A, the incident wave 162 is reflected by the reflector unit 170 in the form of a re-radiated wave 164, a scattered wave 166, and a specular wave 168. The re-radiated wave 164 reflected from the offset-fed reflector antenna system can sometimes result in additional polarization mismatch due to polarization impurity of the incident wave that is caused by the oblique angle at which the reflector unit 170 is illuminated.

Figure 2A:
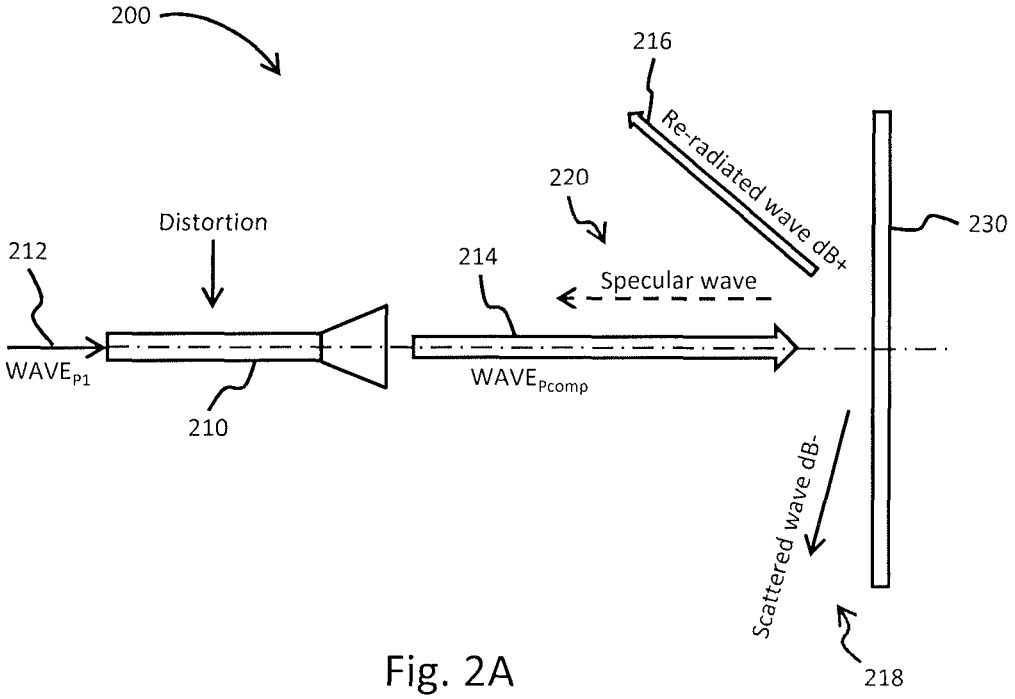
FIG. 2A is a diagram of a reflector antenna system incorporating pre-distortion, according to one embodiment.

FIG. 2A illustrates a reflector antenna system 200 incorporating pre-distortion, according to one embodiment. The reflector antenna system 200 includes a feed unit 210, and a reflector unit 230. The feed unit 210 receives an input wave 212 which has a preset polarization. Depending on the specific implementation, the input wave 212 can be generated by circuitry within the feed unit 210 based on a received signal. The input wave 212 can also be generated by an external controller, processing unit, etc. According to the illustrated embodiment, the input wave 212 is subjected to distortion within the feed unit 210. The distortion is designed to change characteristics of the input wave 212 based, at least in part, on properties of the reflector unit 230. According to at least one embodiment, the distortion can be selected to change the polarization of the input wave 212 based on an axial ratio of waves reflected by the reflector unit 230. The feed unit 210 subsequently outputs an incident wave 214 which has a compensated polarization. More particularly, the polarization of the input wave 212 is changed to produce a different polarization (i.e., the compensated polarization). The incident wave 214, having the compensated polarization, is used to illuminate the surface of the reflector unit 230.

A reflection is subsequently generated by the reflector unit 230 based, at least in part, on properties such as phase delay lines, patch size, etc. Specifically, the reflection consists of a re-radiated wave 216, a scattered wave 218, and a specular wave 220. As previously discussed, the re-radiated wave 216 corresponds to the desired (or useful) component of the total reflection from the reflector unit 230. The re-radiated wave 216 results from resonant activity of elements of the reflector unit 230 and has $E_x$ and $E_y$ components which define an axial ratio characterizing its polarization. Since the polarization of the input wave 212 cannot be precisely reproduced when the re-radiated wave 216 is reflected, a polarization mismatch would normally be created between the polarization of the re-radiated wave 216 and that of the input wave 212. The scattered wave 218 corresponds to a non-resonant component of the total reflection resulting from the physical structure of the reflector element 230. The specular wave 220 is an unavoidable component of the total reflection which results from the ground plane of the reflector unit 230.

As previously discussed, the feed unit 210 applies a distortion to the input wave 212 in order to generate the incident wave 214 having the compensated polarization. The compensated polarization causes the re-radiated wave 216 to be reflected by the reflector unit 230 with a polarization which more accurately reflects the polarization of the input wave 212. This causes a reduction or elimination of any polarization mismatch that would have otherwise existed between the input wave 212 and the re-radiated wave 216. Thus, the re-radiated wave 216 is reflected by the reflector unit 230 with an increased (or greater) signal strength (dB). As previously discussed, the specular wave 220 is an inevitable component of the total reflection which results from the ground plane of the reflector unit 230. Thus, the level of the specular wave 220 does not change. The increased strength of the re-radiated wave 216, therefore, causes an advantageous reduction in the level of the scattered wave 218.

According to at least one embodiment, the reflector unit 230 can be configured as an active array reflector which contains a plurality of small antenna units that process the incident wave 214 to produce the re-radiated wave 216, scattered wave 218, and specular wave 220. According to further embodiments, the reflector unit 230 can be configured as a passive reflector which does not actively process and steer the input wave 214. Accordingly, the reflector unit 230 would passively reflect the components of the incident wave 214 based on its reflective properties, axial ratio of waves being reflected, etc.

Figure 2B:
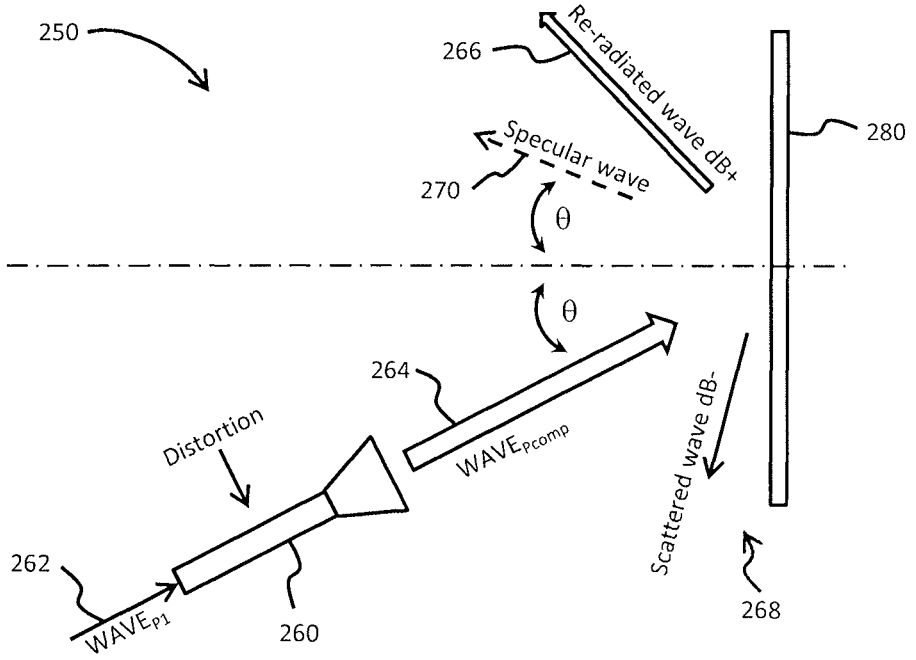
FIG. 2B is a diagram of a reflector antenna system incorporating pre-distortion, according to another embodiment.

FIG. 2B is a diagram of an embodiment for a reflector antenna system 250 that is configured as an offset-fed reflector antenna system. According to the illustrated embodiment, the reflector antenna system 250 includes a feed unit 260 that is provided at an offset angle θ relative to the centerline of a reflector unit 280. Similar to the embodiment illustrated in FIG. 2B, the feed unit 260 receives an input wave 262 which has a preset polarization. The input wave 212 can be generated, for example, by circuitry within the feed unit 260, or external hardware, based on a received signal. The input wave 262 is subjected to distortion within the feed unit 260 using various techniques. The distortion is designed to change characteristics of the input wave 262 based, in part, on properties of the reflector unit 280. According to one or more embodiments, the distortion can be selected to change the polarization of the input wave 262 based, at least in part, on an axial ratio of waves reflected by the reflector unit 280. The distortion causes the feed unit 260 to output an incident wave 264 which has a compensated polarization. More particularly, the polarization of the input wave 262 is changed to produce a different polarization (i.e., the compensated polarization). The incident wave 264, having the compensated polarization, is used to illuminate the surface of the reflector unit 280.

The reflector unit 280 subsequently generates a reflection based, at least in part, on properties such as phase delay lines, patch size, etc. As previously discussed, the reflection consists of a re-radiated wave 266, a scattered wave 268, and a specular wave 270. The feed unit 260 applies a distortion to the input wave 262 in order to generate the incident wave 264 which has the compensated polarization. The compensated polarization causes the re-radiated wave 266 to be reflected by the reflector unit 280 with a polarization which more accurately reflects the polarization of the input wave 262. This causes a reduction or elimination of any polarization mismatch that would have existed between the input wave 262 and the re-radiated wave 266. Thus, the re-radiated wave 266 is subsequently reflected by the reflector unit 280 with an increased signal strength (dB), while the scattered wave 268 is reflected with reduced signal strength.

According to one or more embodiments, the reflector unit 280 can be configured as an active array reflector which contains a plurality of small antenna units configured to process the incident wave 264, and produce the re-radiated wave 266, scattered wave 268, and specular wave 280. Other embodiments, however, can provide for a reflector unit 280 which passively reflects the components of the incident wave 264 based on its reflective properties, axial ratio of waves being reflected, etc.

Figure 3A:
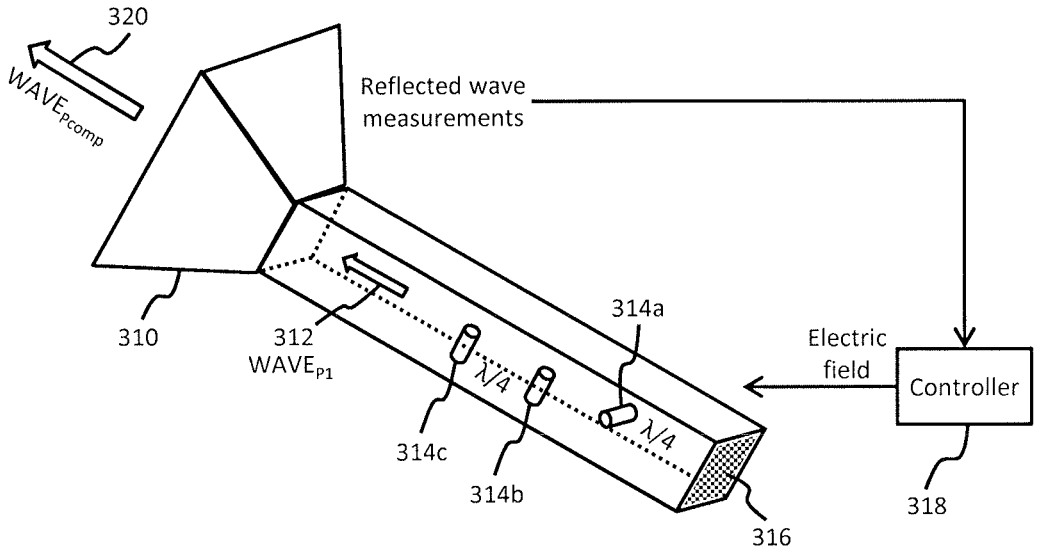
FIG. 3A is a diagram of an arrangement for pre-distorting an input wave using orthogonal pins, according to various embodiments.

FIG. 3A is a diagram of an arrangement for pre-distorting an input wave within a feed unit, in accordance with at least one embodiment. The illustrated feed unit 310 is configured as a horn type feed unit which can be used to illuminate the surface of a reflector unit such as those illustrated in FIGS. 2A and 2B. The feed unit 310 includes a first pin 314*a* that is inserted within one of its interior surfaces. A second pin 314*b* and a third pin 314*c* are inserted into an interior surface of a second side of the feed unit 310 such that they are orthogonal to the first pin 314*a*. It should be noted, however, that the first pin 314*a*, and the second and third (314*b*, 314*c*) can be inserted into any sides of the feed unit 310 as long as they are orthogonal to each other. The first pin 314*a*, the second pin 314*b*, and the third pin 314*c* can also be spaced apart along the length of the feed unit 310 by predetermined distances in order to create a desired phase delay.

According to the embodiment illustrated in FIG. 3A, first pin 314*a* can be located a quarter wave (λ/4) distance from a conductive backing 316 located at an end of the feed unit 310. Depending on the specific implementation, the conductive backing 316 can be made of various types of electrically conductive materials including metals, conductive polymers, etc. The second pin 314*b* and the third pin 314*c* can be spaced apart from each other by a quarter wave (λ/4) distance. According to the illustrated embodiment, the first pin 314*a*, the second pin 314*b*, and the third pin 314*c* are subsequently excited in order to generate an input wave 312 having the desired polarization. For example, the first pin 314*a* can be excited to generate a portion of the input wave 312 that is reflected by the conductive backing 316 and directed to the exit of the feed unit 310. The second pin 314*b* and the third pin 314*c* function as a pair, such that the third pin 314*c* is excited to generate a portion of the input wave 312 and the second pin 314*b* is grounded to reflect a portion of the generated wave that propagates in the direction of the conductive backing 316 toward the exit of the feed unit 310. According to at least one embodiment, electric fields having predetermined amplitudes and phases can be applied to the first pin 314*a* and the third pin 314*c* to generate the input wave 312. The electric fields can be selected such that they are identical to each other. The electric fields can also be selected such that they have different amplitudes and phases. Accordingly, a first electric field having a first amplitude and a first phase can be applied to the first pin 314*a*, while a second electric field having a second amplitude and a second phase can be applied to the third pin 314*c*. For example, the first pin 314*a* can be excited with an electric field resulting in $E_x$ having with an amplitude of 5 V/m and phase of 35°, while the third pin 314*c* is excited with an electric field resulting in $E_y$ having an amplitude of 1 V/m and phase of 80°.

According to one or more embodiments, a controller 318 can be provided to generate and/or control the properties of each electric field being applied to the first pin 314*a* and the third pin 314*c*, thereby generating the input wave 312. The feed unit 310 subsequently outputs an incident wave 320 (or compensated wave) having a compensated polarization to illuminate the surface of the reflector unit. Depending on the specific implementation, one or more sensors can be provided to measure different properties of the reflector antenna system. For example, the sensors can be used to measure different properties associated with the compensated wave 320, re-radiated wave, scattered wave, specular wave, etc. Information from the sensors can then be supplied to the controller 318 in order to adjust the electric fields being applied, based on real-time operation.

Figure 3B:
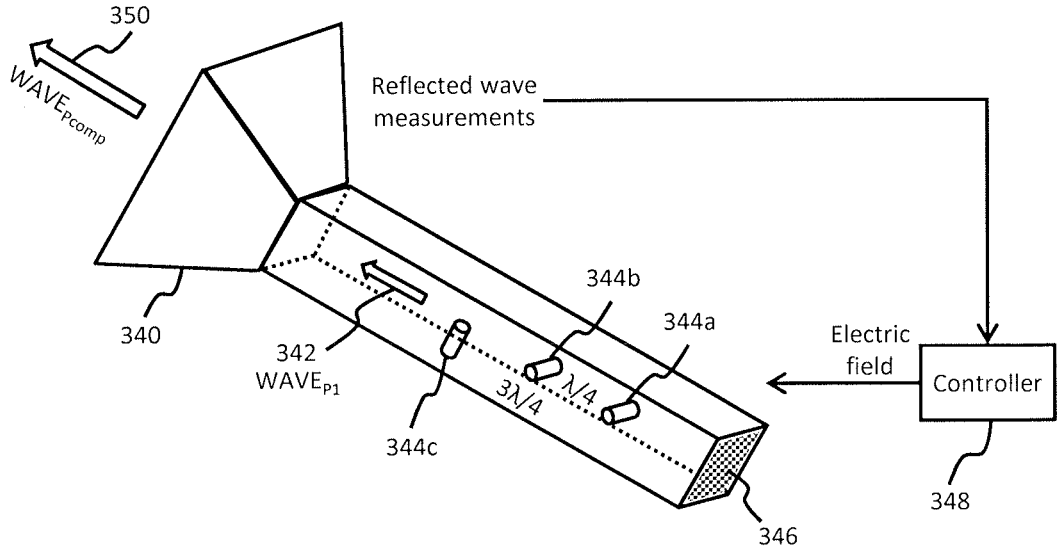
FIG. 3B is a diagram of an arrangement for pre-distorting an input wave using orthogonal pins, according to additional embodiments.

FIG. 3B is a diagram of an arrangement for pre-distorting an input wave within a feed unit, in accordance with another embodiment. The feed unit 340 is configured as a horn type feed unit capable of illuminating the surface of a reflector unit such. Similar to the embodiment shown in FIG. 3A, the feed unit 340 includes a first pin 344*a* and a second pin 344*b* that are inserted within one of its interior surfaces. A third pin 344*c* is inserted into an interior surface of a second side of the feed unit 340 such that it is orthogonal to the first pin 344*a* and the second pin 344*b*. According to the illustrated embodiment, the first pin 344*a* and the second pin 344*b* are spaced apart from each other by a quarter wave (λ/4) distance. The third pin 344*c* is located three quarter wave (3λ/4) distance from a conductive backing 346 located at an end of the feed unit 340. The first pin 344*a*, the second pin 344*b*, and the third pin 344*c* are subsequently excited in order to generate an input wave 342 having the desired polarization. The first pin 344*a* and the second pin 344*b* are excited as a pair, such that the second pin 344*b* generates a portion of the input wave 342 and the first pin 344*a* is grounded to reflect a portion of the generated wave that propagates in the direction of the conductive backing 346 toward the exit of the feed unit 340. The third pin 314*a* is excited to generate a portion of the input wave 342 that is reflected by the conductive backing 346 and directed to the exit of the feed unit 340.

According to various embodiments, electric fields having predetermined amplitudes and phases can be applied to the second pin 344*b* and the third pin 344*c* to generate the input wave 312. The electric fields can be selected such that they are identical to each other, or they can have different amplitudes and phases. A controller 348 can be provided to generate and/or control the properties of each electric field being applied to the first pin 344*a* and the third pin 344*c* in order to generate the desired input wave 342. The feed unit 340 subsequently outputs a compensated wave 350 having a compensated polarization to illuminate the surface of the reflector unit. One or more sensors can also be provided to measure different properties of the reflector antenna system. The sensors can be used, for example, to measure different properties associated with the compensated wave 350, re-radiated wave, scattered wave, specular wave, etc. Information from the sensors can then be supplied to the controller 348 in order to adjust the electric fields being applied, based on real-time operation.

Figure 4A:
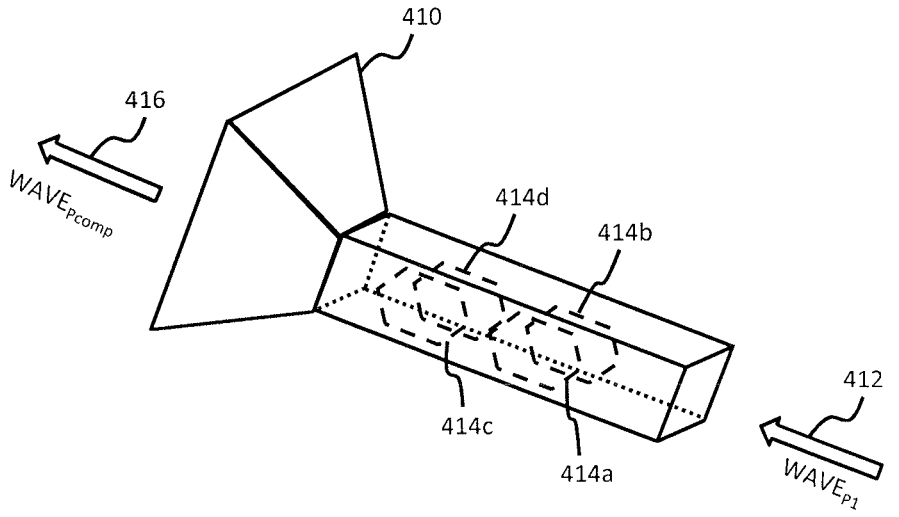
FIG. 4A is a diagram of an arrangement for pre-distorting an input wave using dielectric slabs, according to one or more embodiments.

FIG. 4A is a diagram of an arrangement for pre-distorting an input wave within a feed unit, according to one or more embodiments. The feed unit 410 is configured such that one or more dielectric slabs are disposed within its interior. The illustrated embodiment shows a total of four dielectric slabs are disposed within the interior of the feed unit. Depending on the specific implementation, a first dielectric slab 414*a* can be aligned with a second dielectric slab 414*b* such that they face each other and have a vertical orientation. The first dielectric slab 414*a* and the second dielectric slab 414*b* can also be staggered such that they are at different linear positions within the feed unit, while still facing each other. A third dielectric slab 414*c* can be aligned with a fourth dielectric slab 414*d* in a similar manner. Furthermore, the first dielectric slab 414*a* and the third dielectric slab 414*c* can be linearly (or sequentially) aligned with each other along the length of the feed unit 410. The second dielectric slab 414*b* and the third dielectric slab 414*d* can also be similarly aligned. Furthermore, the dielectric 414 slabs can be both sequentially arranged and across from each other, as shown in FIG. 4A. The dielectric slabs 414 can, therefore, be arranged in any configuration suitable to generate the desired distortion.

Each dielectric slab 414 can be selected such that it has a predetermined dielectric constant capable of achieving the desired changes in the polarization of an input wave 412. According to various embodiments, the input wave 412 can be generated at an external source and supplied to the feed unit 410. If multiple dielectric slabs 414 are utilized, their combined dielectric constants, as well as locations within the feed unit 410, are used to produce the desired changes in polarization of the input wave 412. Thus, as the input wave 412 passes through one or multiple dielectric slabs 414, the various dielectric constants change the polarization of the input wave 412 such that a compensated wave 416 having a compensated polarization is output from the feed unit 410. The compensated wave 416 is subsequently used to illuminate the surface of the reflector unit.

Figure 4B:
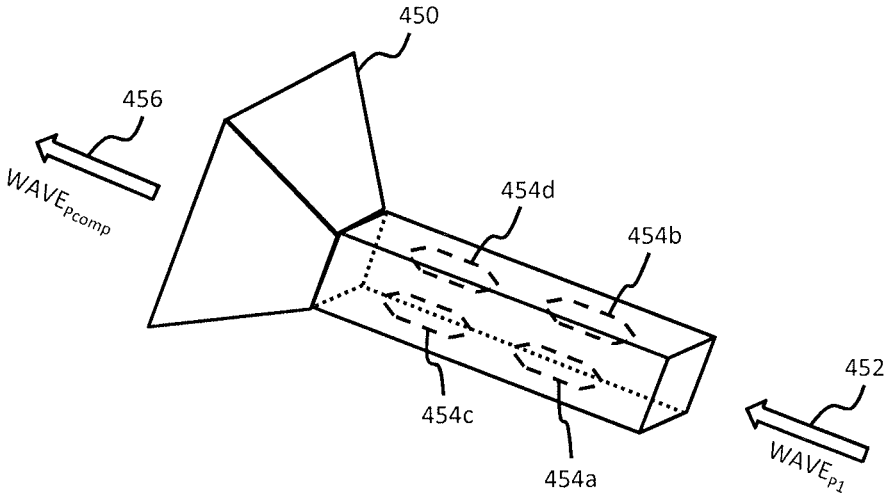
FIG. 4B is a diagram of an arrangement for pre-distorting an input wave using dielectric slabs, according to various embodiments.

FIG. 4B is a diagram of an arrangement for pre-distorting an input wave within a feed unit, according to further embodiments. The feed unit 450 is configured such that a first dielectric slab 454*a* is aligned with a second dielectric slab 454*b* such that they face each other and are oriented horizontally. The first dielectric slab 454*a* and the second dielectric slab 454*b* can also be staggered such that they are at different linear positions within the feed unit, while still facing each other. A third dielectric slab 454*c* can be aligned with a fourth dielectric slab 454*d* in a similar manner. The first dielectric slab 454*a* and the third dielectric slab 454*c* can also be linearly (or sequentially) aligned with each other along the length of the feed unit 450. The second dielectric slab 454*b* and the third dielectric slab 454*d* can be aligned in a similar manner. Furthermore, the dielectric slabs 454 can be both sequentially arranged and across from each other, as shown in FIG. 4B. The dielectric slabs 454 can, therefore, be arranged in any configuration suitable to generate the desired distortion.

Each dielectric slab 454 can be selected such that it has a predetermined dielectric constant capable of achieving the desired changes in the polarization of an input wave 452 that is supplied to the feed unit. If multiple dielectric slabs 454 are utilized, the combined dielectric constants and locations within the feed unit 450, are used to produce the desired changes in polarization of the input wave 452. The various dielectric constants change the polarization of the input wave 452 such that a compensated wave 456 having a compensated polarization is output from the feed unit 450. The compensated wave 456 is subsequently used to illuminate the surface of the reflector unit. While FIGS. 4A and 4B illustrate different configurations of dielectric slabs, it should be noted that such configurations are only illustrative, and not intended to be limiting. Rather, any number of dielectric slabs can be utilized, and the dielectric slabs can be arranged in any configuration that achieves a desired polarization.

Figure 5A:
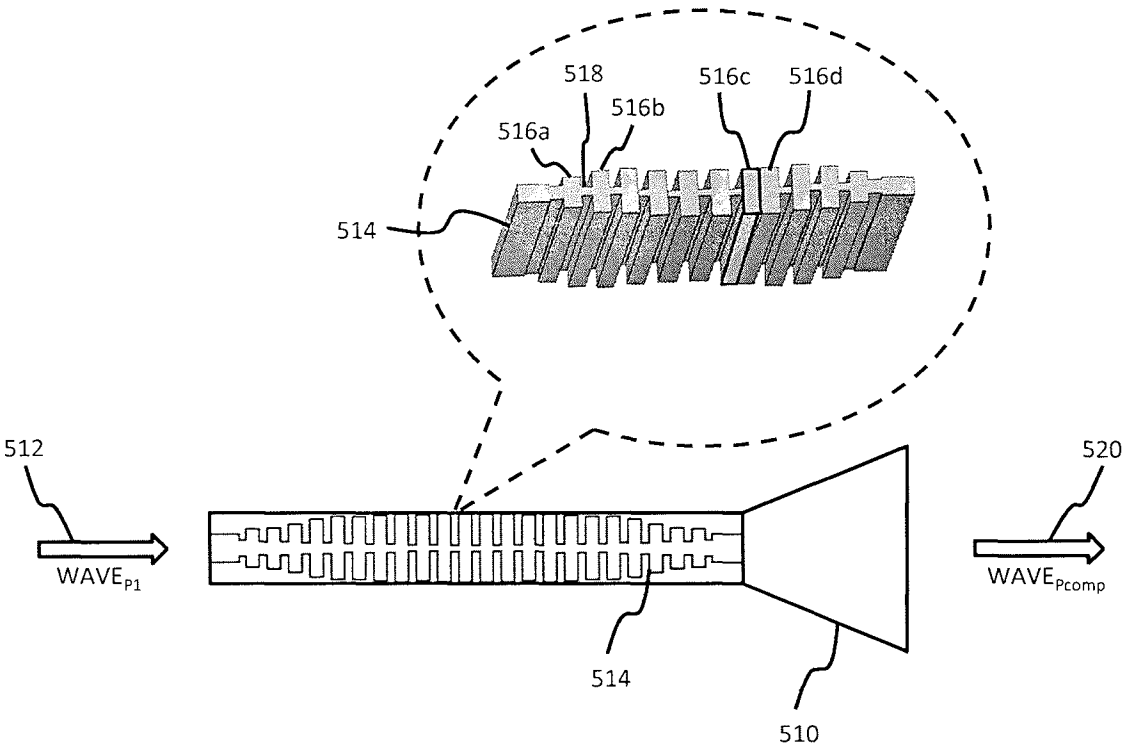
FIG. 5A is a diagram of an arrangement for pre-distorting an input wave, according to one embodiment.

FIG. 5A is a diagram of an arrangement for pre-distorting an input wave within a feed unit, according to at least one embodiment. The feed unit 510 includes a corrugated waveguide 514 disposed within its interior. The corrugated waveguide 514 functions to distort the polarization of an input wave 512 based on a predetermined or desired criteria. For example, the amount of distortion can be based on the axial ratio of certain wave components reflected by the reflector unit. The specific design of the corrugated waveguide 514 can, therefore, vary based on the desired change in polarization. The corrugated waveguide 514 shown in FIG. 5A, for example, includes ends that are symmetrically tapered. Such a configuration can provide impedance matching properties to the feed unit 510. Embodiments which do not require impedance matching, however, can utilize corrugated waveguides without any tapered ends or only one tapered end.

As illustrated in FIG. 5A, for example, the corrugated waveguide 514 can include a plurality of rectangular nodes 516 (or nodes) that are independently sized to achieve the desired change in polarization. According to at least one embodiment, two nodes such as node 516*a* and 516*b* can be connected to each other by means of a cavity or diaphragm 518 interposed between them. According to another embodiment, adjacent nodes can be directly connected to each other. For example, node 516*c* can be directly connected to node 516*d*. Accordingly, the size of each node 516 can be different or identical, and various options can be used to interconnect adjacent nodes of the corrugated waveguide 514. The distance between individual nodes 516 can also vary based on specific design requirements. As the input wave 512 travels through the feed unit 510, the corrugated waveguide 514 provides the necessary distortion to change the phase of the input wave 512. This results in an output (or compensated) wave 520 which has a compensated polarization resulting from the corrugated waveguide 514. The feed unit 510 subsequently illuminates the surface of the reflector unit with the compensated wave 518.

Figure 5B:
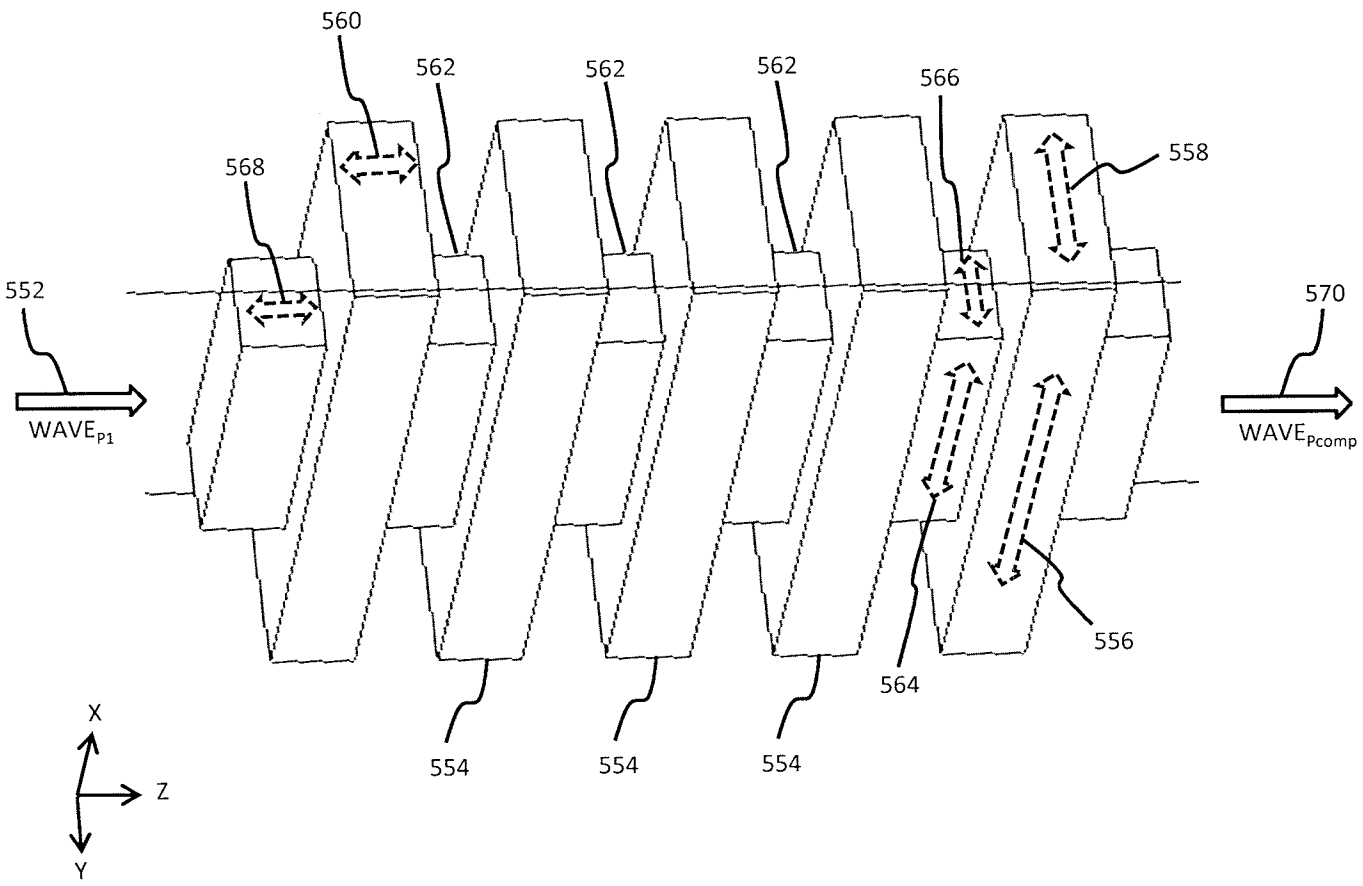
FIG. 5B is a diagram of a corrugated waveguide that can be used to pre-distort an input wave, according to various embodiments.

FIG. 5B illustrates a corrugated waveguide for pre-distorting an input wave in accordance with various embodiments. The corrugated waveguide 550 includes a plurality of rectangular nodes 554 (or nodes) that are configured to distort the polarization of an input wave 552 based on a desired criteria such as, for example, the axial ratio of certain wave components reflected by a corresponding reflector unit. According to the illustrated embodiment, the rectangular nodes 554 can be independently sized along multiple dimensions in order to achieve the desired change in polarization. For example, each rectangular node 554 can be adjusted along a first dimension 556 (e.g., X-axis), a second dimension 558 (e.g., Y-axis), and/or a third dimension 560 (e.g., Z-axis). Each rectangular node 554 can, therefore, be adjusted along one, two, or all three of the foregoing dimensions. According to further embodiments, each rectangular cavity 562 can also be adjusted along a first dimension 564 (e.g., X-axis), a second dimension 566 (e.g., Y-axis), and/or a third dimension 568 (e.g., Z-axis).

Similar to the embodiment illustrated in FIG. 5A, the corrugated waveguide 550 is disposed within the interior of the feed unit. Furthermore, adjacent nodes 554 can be connected to each other by means of a cavity 562, diaphragm, or direct connection. Accordingly, the size of each node 554, the size of each cavity 562, and distance between adjacent nodes 554 can be different or identical, depending on specific design requirements. As the input wave 552 travels through the feed unit, the corrugated waveguide 550 provides the necessary distortion to change the phase of the input wave 552. This produces an output wave 570 (or compensated wave) which has a compensated polarization resulting from the different nodes 554 within the corrugated waveguide 550. The output wave 570 is subsequently used to illuminate the surface of the reflector unit.

Figure 6:
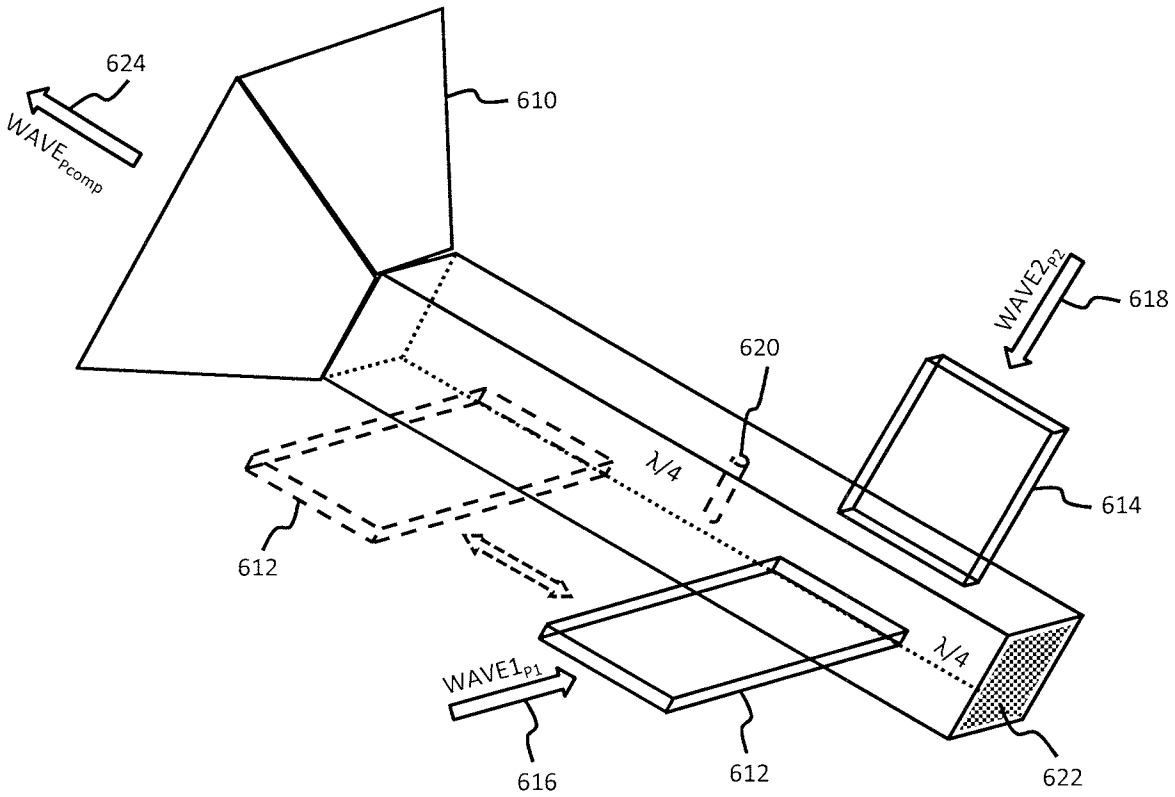
FIG. 6 is a diagram of an arrangement for pre-distorting an input wave using waveguide ports, according to various embodiments.

FIG. 6 is a diagram of an arrangement for pre-distorting an input wave within a feed unit, in accordance with one or more embodiments. The illustrated feed unit 610 is configured as a horn type feed unit which can be used to illuminate the surface of a reflector unit (not shown). The feed unit 610 includes a first waveguide port 612 that is inserted within one of its sides. A second waveguide port 614 is inserted into a second side of the feed unit 610 that is orthogonal to the side having the first waveguide port 612. According to an embodiment, the first waveguide port 612 and the second waveguide port 614 are aligned with each other and positioned a quarter wave (λ/4) distance from a conductive backing 622 located at an end of the feed unit 610. The first waveguide port 612 directs a first input wave 616 having a first polarization into the feed unit, while the second waveguide port 614 directs a second input wave 618 having a second polarization into the feed unit 610. The first input wave 616 and the second input wave 618 can be generated externally using a variety of known methods. The first input wave 616 and the second input wave 618 are combined and directed to the exit of the feed unit. A portion first input wave 616 and a portion of the second input wave 618 directed toward the conductive backing 622 are reflected to the exit of the feed unit 610. All the waves are combined to exit of the feed unit 610 with a compensated polarization. Specifically, a compensated wave 624 is generated within the feed unit 610 and used to illuminate the surface of a reflector unit.

According to at least one embodiment, the first waveguide port 612 can be positioned such that it is not aligned with the second waveguide port 614, as illustrated by the dashed lines. According to such embodiments, an orthogonal pin 620 can be positioned within the feed unit 610 at a quarter wave (λ/4) distance to function as a grounding port for the first waveguide port 614, thereby reflecting the first input wave 616 outward. The second input wave 618 would be reflected by the conductive backing 622 toward the exit of the feed unit.

Figure 7:
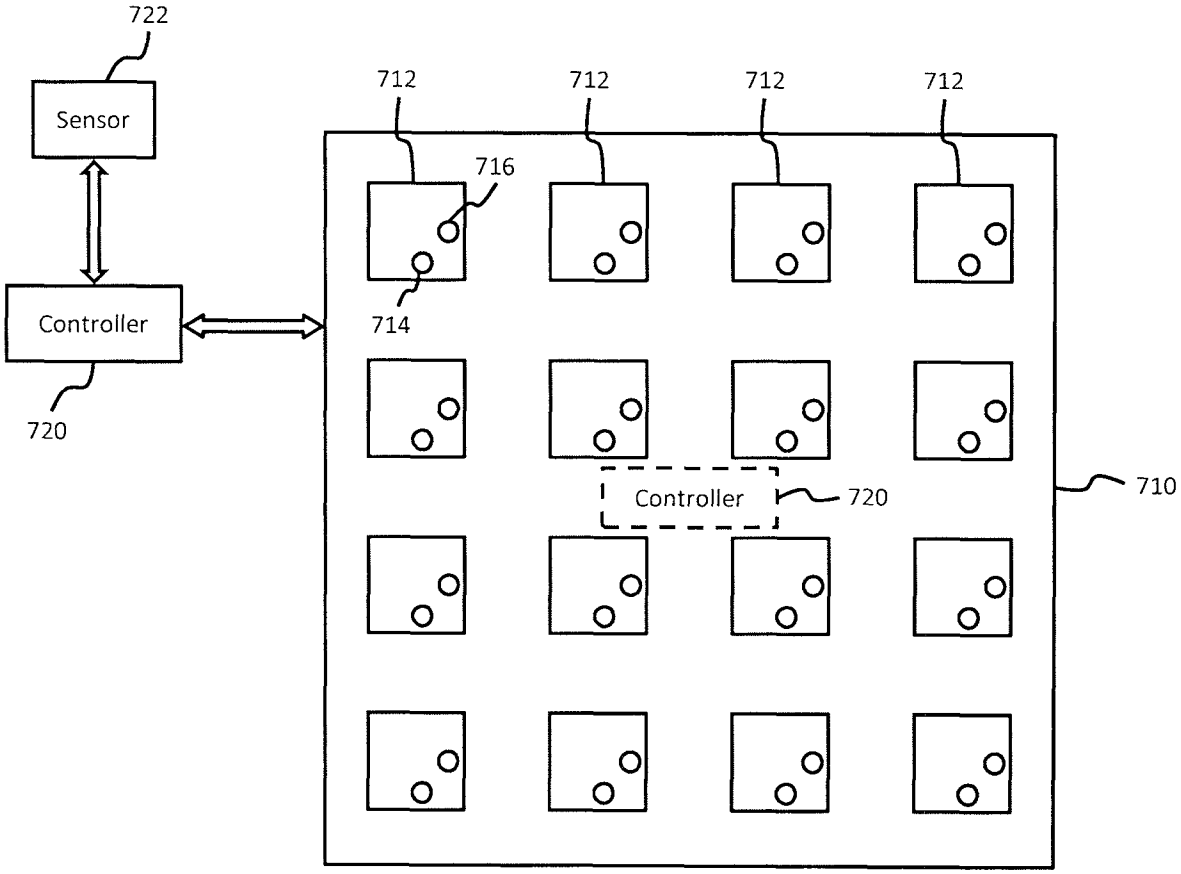
FIG. 7 is a diagram of an arrangement for pre-distorting an input wave, according to various embodiments.

FIG. 7 is a diagram of an arrangement for pre-distorting an input wave, according to various embodiments. The feed unit 710 is configured as an active array feed unit which includes a plurality of phased array elements 712 that are capable of collectively distorting the polarization of an input wave. The distortion produces a desired compensated wave capable of being used to illuminate the surface of the reflector unit. According to the illustrated embodiment, each phased array element 712 can include a first port 714 and a second port 716 in order to generate any elliptical polarization, including linear and circular. Furthermore, each port 714 can be in the form of a beam former chip capable of independently controlling the phase and amplitude of the signal. Additionally, the controller 720 can be programmed to control operation of the beam former chips. Thus, an exemplary phased array element 712 can include a first port 714 in the form of a beam former chip and a second port 716 in the form of a beam former chip. Depending on the type and amount of phase shifting required, additional ports (not shown) can be added to each phased array element 712.

According to at least one embodiment, a controller 720 can be provided to apply control signals to the phased array elements 712 in order to achieve the desired phase shift for changing the polarization of the input wave. The controller 720 can be configured to apply the same control signal to all phased array elements 712, or to apply an independent control signal to each individual phased array element 712 in order to achieve the desired polarization change. Depending on the specific implementation, the controller 720 can be co-located within the feed unit 710, or it can be positioned externally from the feed unit 710.

According to at least one embodiment, the feed unit 710 can be configured to dynamically adjust the amount of distortion generated to change the phase of the input wave. For example, at least one sensor 722 can be provided to measure various properties of wave components reflected by the reflector unit. The sensors 722 can measure properties such as the strength, polarization, axial ratio, etc. of the re-radiated wave, the scattered wave, and/or the specular wave. Furthermore, the sensors 722 can be configured to detect the polarization of the compensated wave being output by the feed unit 710 to illuminate the surface of the reflector unit. According to one or more embodiments, such measurements can be fed back to the controller 720 in real time in order to determine whether polarization mismatch currently exists and the amount of mismatch. The controller 720 can subsequently make any calculations to adjust the control signals, if necessary, in order to maintain and/or improve system performance. The controller 720 can also make such calculations in order to achieve desired properties for the compensated wave or reflected wave components based on current environmental/atmospheric conditions.

Figure 8:
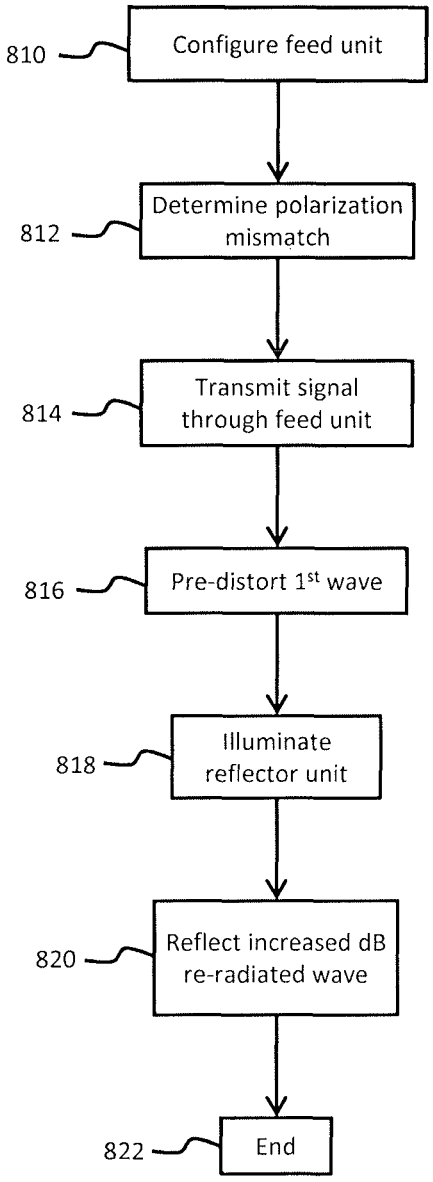
FIG. 8 is a flowchart of a process for pre-distorting an input wave, according to one embodiment.

FIG. 8 is a flowchart of a process for pre-distorting an input wave, according to one embodiment. At 810, the feed unit is configured for operation. Depending on the particular embodiment, this can correspond to providing the physical and electronic components necessary for generating distortion in the input wave. For example, components such as dielectric slabs, corrugated waveguides, etc. can be positioned within the feed unit. At 812, the polarization mismatch, between the input wave polarization and the polarization properties/settings of the reflector unit, is determined. At 814, a signal such as the input wave (or first wave) is transmitted through the feed unit. At 816, the input wave (or first wave) is pre-distorted in accordance with the configuration settings of the feed unit. As previously discussed, the pre-distortion causes a change in the polarization of the input wave. The amount of pre-distortion applied to the input wave can be based on various factors including, but not limited to, properties of the feed unit and the reflector unit. The pre-distortion results in a compensated wave having a polarization which differs from that of the input wave.

At 818, the reflector unit is illuminated with the compensated wave. More particularly, the feed unit directs the compensated wave toward the surface of the reflector unit. At 820, the reflector unit reflects a re-radiated wave having an increased signal strength. As previously discussed, the compensated wave is typically reflected in the form of three component waves. The re-radiated wave is a useful component can cause the polarization mismatch with the input wave. Thus, the level of the re-radiated wave increases as the polarization mismatch is reduced and/or eliminated by the compensated wave. Depending on the configuration of the reflector unit, the compensated wave can be processed prior to being reflected when active array elements are used. The process ends at 822.

Figure 9:
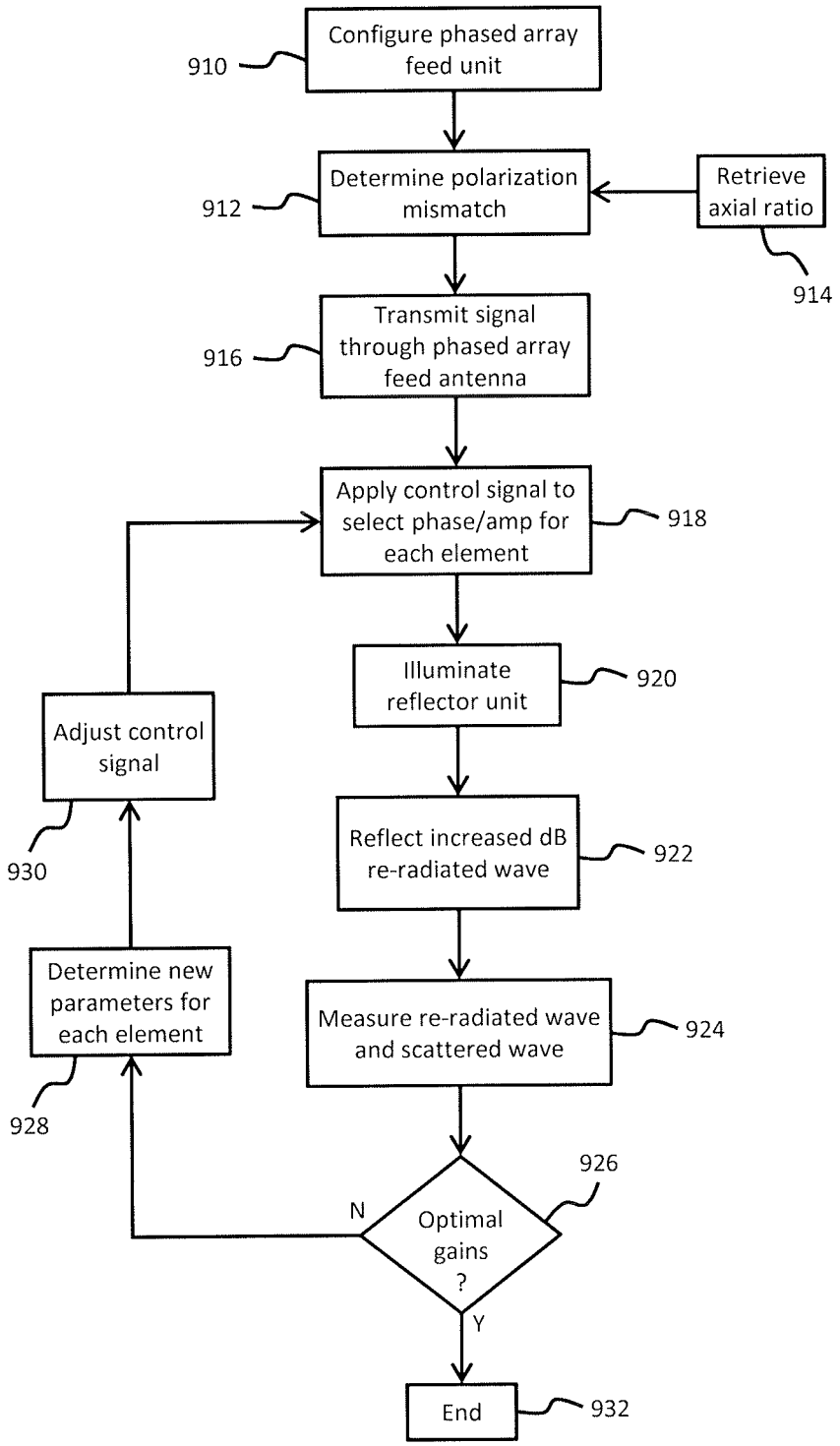
FIG. 9 is a flowchart of a process for pre-distorting an input wave, according to at least one embodiment.

FIG. 9 is a flowchart of a process for pre-distorting an input wave, according to at least one embodiment. At 910, a phased array feed unit is configured for illuminating the surface of the reflector unit. According to one embodiment, such configuration may involve selecting the appropriate phased array elements that will be utilized in the feed unit. For example, the phased array elements can have two or more ports corresponding to pin diodes which can be controlled to generate a desired distortion on an input wave. Furthermore, a controller can be selected and/or programmed to monitor and control operation of the phased array elements. At 912, a polarization mismatch is determined between the polarization of the input wave and the polarization associated with the reflector unit.

According to at least one embodiment, a factor contributing to the polarization mismatch is the axial ratio of waves reflected by the reflector unit, dielectric properties of the reflector unit, etc. This information can be supplied to the feed unit in advance. Alternatively, at 914, the axial ratio (and other properties) associated with the reflector unit is retrieved. For example, a value for the axial ratio can be stored in a storage device, such as those discussed in greater detail below, that is accessible by the feed unit. According to various embodiments, however, the axial ratio can be stored in nonvolatile storage within the controller or feed unit.

At 916, the input wave is transmitted through the phased array elements of the feed unit. At 918, the controller applies a control signal to select the particular phase and amplitude for each phased array element in order to generate the desired amount of pre-distortion. This results in a compensated wave having properties which differ from those of the input wave. At 920, the feed unit illuminates the surface of the reflector unit with the resulting compensated wave. At 922, the reflector unit reflects the compensated wave in the form of various components, including a re-radiated wave component whose signal strength is increased due to reduction or elimination of polarization mismatch resulting from the distortion introduced by the phased array elements.

Various embodiments can allow for analysis of the reflected wave components in real time and adjustment of the control signal to achieve desired results. For example, the level of the re-radiated wave and scattered wave reflected by the reflector unit can be measured at 924 using one or more sensors. Depending on the specific implementation, such measurements can be performed in order to determine whether the distortion introduced by the feed unit generates any effective improvements in the reflected wave components. At 926, it is determined whether the level of the re-radiated wave and scattered wave meet optimal gain requirements. According to at least one embodiment, for example, the levels of the reflected wave components can be continually measured while making adjustments in order to determine whether or not the signal strength of the re-radiated wave increases and/or the signal strength of the scattered wave decreases. The levels of the reflected wave components can also be measured at specific intervals. A predetermined threshold criteria can also be set for the amount of change considered to be negligible or sufficient.

If optimal gains have not been reached, control passes to 928, where a new set of parameters is determined for each phased array element. Depending on the specific implementation, however, the same set of parameters can be applied unilaterally to all of the phased array elements. At 930, the controller adjusts the control signal being supplied to the phased array elements. Depending on the specific implementation, the controller may supply control signals to beam former chips for adjusting the phase and amplitude parameters. Control then returns to 918, where the control signal is applied to each of the phased array elements. If optimal gains have been achieved at 926, the process subsequently ends at 932. According to various embodiments, however, control can optionally return to 926 in order to continually monitor the reflected wave components and/or adjust the parameters of the phased array elements.

Figure 10:
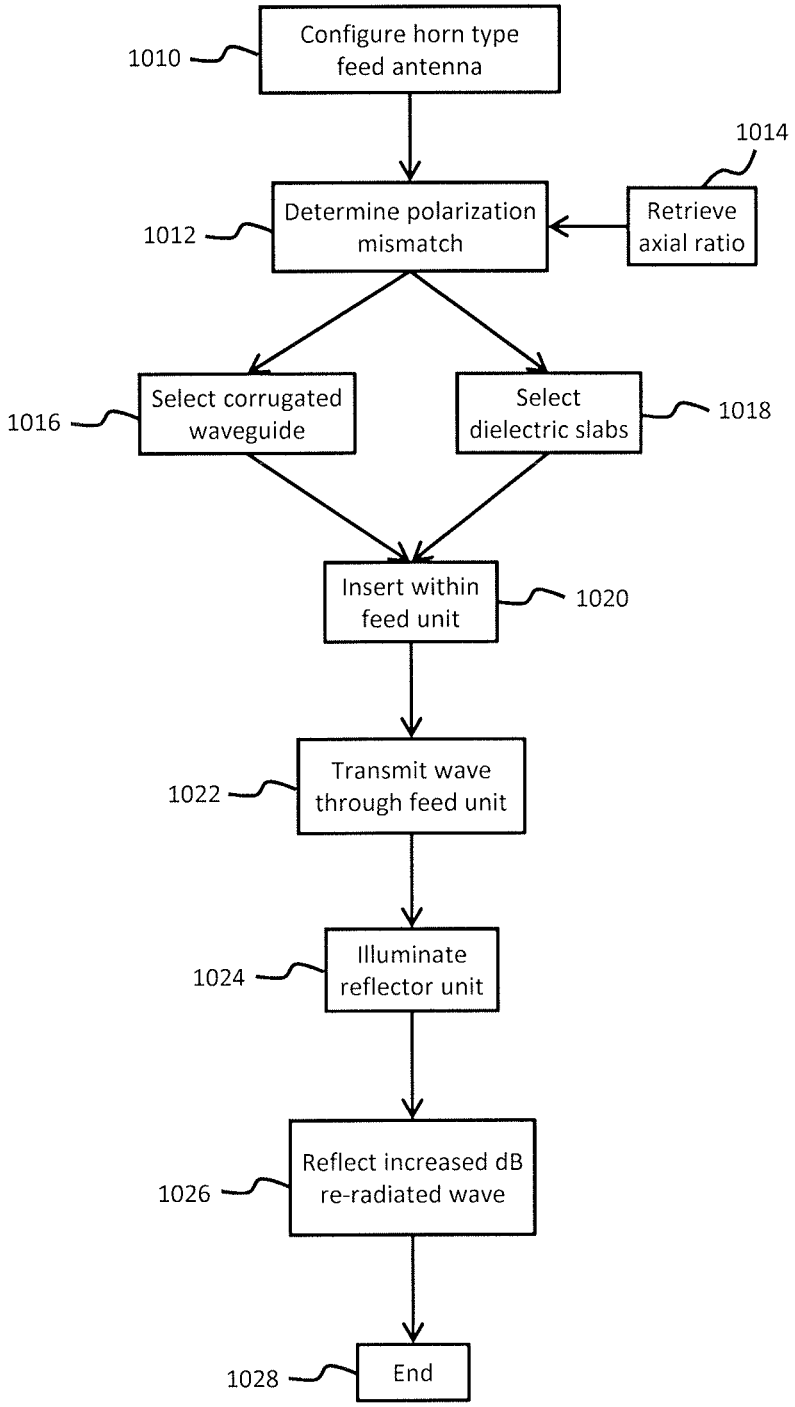
FIG. 10 is a flowchart of a process for pre-distorting an input wave, according to various embodiments.

FIG. 10 is a flowchart of a process for pre-distorting an input wave, according to various embodiments. At 1010, a horn type feed unit is configured for illuminating the surface of a reflector unit of a reflector antenna system. For example, if the distortion will be generated using a corrugated waveguide, then the feed unit is selected to accommodate the required corrugated waveguide. Similarly, if dielectric slabs will be used to generate the distortion, then the feed unit is selected such that it can accommodate one or more dielectric slabs. At 1012, a polarization mismatch between the input wave and reflected wave components is determined. According to one or more embodiments, the polarization mismatch can be obtained by using an axial ratio associated with the reflector unit. The axial ratio can be retrieved, at 1014, for the specific reflector unit being used in order to determine the appropriate polarization mismatch. At this stage, a selection can be made, for example, regarding the specific materials that will be used to generate the distortion.

According to the illustrated embodiment, if a corrugated waveguide will be used, then control passes to 1016. The specific waveguide having the desired number of nodes and connector types is selected in order to generate the appropriate amount of distortion. The waveguide would subsequently be inserted within the feed unit at 1020. Alternatively, if dielectric slabs will be utilized to generate the distortion, they are selected at 1018. More particularly, one or more dielectric slabs having an appropriate size and dielectric constant can be selected so that the desired amount of distortion is achieved. Upon selecting the proper dielectric slabs, they are inserted within the feed unit at 1020. As previously discussed, it is possible to utilize a single dielectric slab having appropriate properties to generate the desired distortion. However, other embodiments allow for multiple dielectric slabs to be utilized in combination for achieving the desired amount of distortion.

At 1022, an input wave is transmitted through the feed unit. As the input wave travels through the feed unit, it encounters either the corrugated waveguide or the dielectric slabs. Such an encounter causes, in part, a change in polarization of the input wave, resulting in a compensated polarization capable of reducing or eliminating the effects of the polarization mismatch. At 1024, the reflector unit is illuminated with the compensated wave. Depending on the specific reflector unit being utilized, some active processing can be performed. If the reflector unit includes active array elements, for example, such elements can process (e.g., steer) the compensated wave to generate the subsequent reflected wave components. At 1026, the reflector unit reflects a re-radiated wave component having an increased signal strength resulting from the distortion introduced within the feed unit. While FIG. 10 only indicates that the re-radiated wave being reflected by the reflector unit, it should be noted that other component waves can be reflected as a result of the reflector unit being illuminated with the compensated wave. For example, a scattered wave component, and a specular wave component can also reflected by the reflector unit. The process subsequently ends at 1028.

Figure 11:
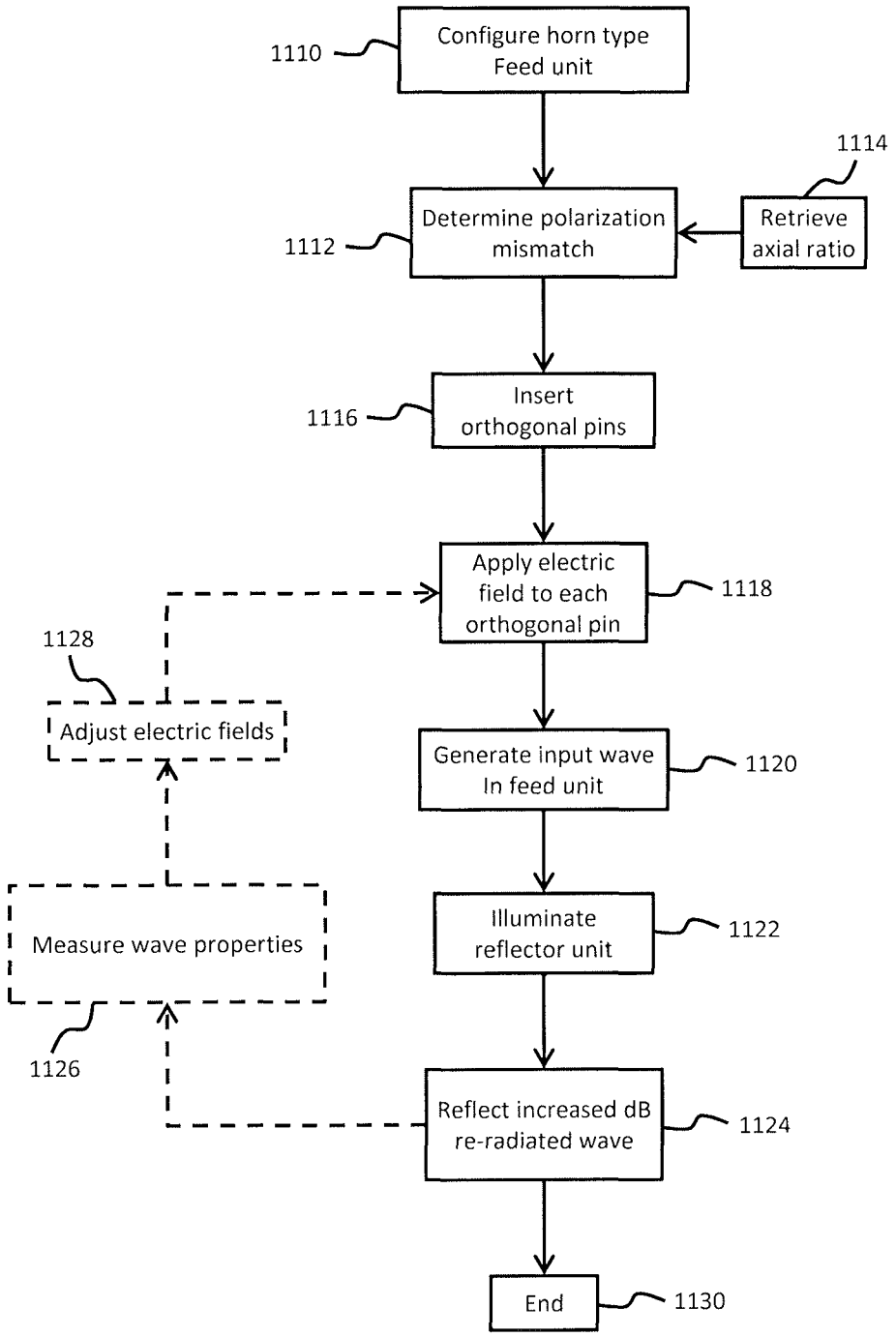
FIG. 11 is a flowchart of a process for pre-distorting an input wave, according to one or more embodiments.

FIG. 11 is a flowchart of a process for pre-distorting an input wave, according to one or more embodiments. At 1110, a horn type feed unit is configured for illuminating the surface of a reflector unit of a reflector antenna system. As previously discussed, such configuration can include selecting appropriate components to generate the required distortion. At 1112, a polarization mismatch between the input wave and reflected wave components is determined based. According to at least one embodiment, the polarization mismatch can be determined, in part, based on an axial ratio associated with the reflector unit. At 1114, the axial ratio is retrieved for the specific reflector unit being used in order to determine the appropriate polarization mismatch. According to further embodiments, the polarization mismatch can be determined based, in part, on the electric field components ($E_x$ and $E_y$) of the feed unit and those of the reflector unit.

At 1116, orthogonal pins are inserted into the feed unit. As previously discussed, the pins can be inserted into any two orthogonal sides of the feed unit. Furthermore, the pins can be spaced apart from each other by a predetermined distance relative to the length of the feed unit in order to provide a phase delay. An electric field is subsequently applied to each pin at 1118. The required electric field can be determined by a controller and/or other appropriate component (e.g., computer, laptop, ASIC, FPGA, etc.). At 1120, an input wave is generated by the pins and transmitted through the feed unit. More particularly, each pin generates a wave that is reflected by either a ground pin or conductive backing. The properties of each wave are altered based, in part, on the distance from ground pin or conductive backing used to reflect it. The reflected waves are subsequently combined to form the input wave that is directed to the exit of the feed unit. The result is an incident (or compensated) wave having a compensated polarization capable of reducing or eliminating the effects of the polarization mismatch. At 1122, the reflector unit is illuminated with the compensated wave. At 1124, the reflector unit reflects, in part, a re-radiated wave component having an increased signal strength resulting from the distortion generated by the electric fields. It should be noted, however, that other wave components are also reflected from the reflector unit.

According to various embodiments, at least one sensor can be provided to measure different characteristics of the reflected wave components. For example, one sensor can be utilized to measure all of the desired characteristics. Alternatively, individual sensors can be provided to measure characteristics of each wave component, specific characters of all wave components, etc. Such measurements can be obtained, for example, at 1126 where various wave properties are optionally measured. As previously discussed, properties of any or all reflected wave components can be measured. Furthermore, properties of the compensated wave can be measured. The properties can be supplied to the controller managing the electric fields. At 1128, the electric fields are adjusted by the controller and applied to each orthogonal pin. If sensors are not utilized to monitor the reflected wave components, however, the process would end at 1130.

Various features described herein may be implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. For example, such hardware/software/firmware combinations can be incorporated into the previously described controllers, sensors, etc. Additionally, components such as the feed unit and reflector antenna can include such hardware to facilitate operation thereof. As previously discussed, the feed unit can include active array elements to distort the input wave. Such hardware/software/firmware combinations can be incorporated within the feed unit, or provided externally, to control the active array elements. Various communication interfaces, including wired and/or wireless, can be used to exchange information between the feed unit and an external control device such as a computer, laptop, DSP, ASIC, FPGA, etc. Similar configurations can be incorporated into the reflector unit, particularly when active array elements are incorporated to steer and reflect the compensated wave.

The terms software, computer software, computer program, program code, and application program may be used interchangeably and are generally intended to include any sequence of machine or human recognizable instructions intended to program/configure a computer, processor, server, etc. to perform one or more functions. Such software can be rendered in any appropriate programming language or environment including, without limitation: C, C++, C#, Python, R, Fortran, COBOL, assembly language, markup languages (e.g., HTML, SGML, XML, VoXML), Java, JavaScript, etc. As used herein, the terms processor, microprocessor, digital processor, and CPU are meant generally to include all types of processing devices including, without limitation, single/multi-core microprocessors, digital signal processors (DSPs), reduced instruction set computers (RISC), general-purpose (CISC) processors, gate arrays (e.g., FPGAs), PLDs, reconfigurable compute fabrics (RCFs), array processors, secure microprocessors, and application-specific integrated circuits (ASICs). Such digital processors may be contained on a single unitary IC die, or distributed across multiple components. Such exemplary hardware for implementing the described features are detailed below.

Figure 12:
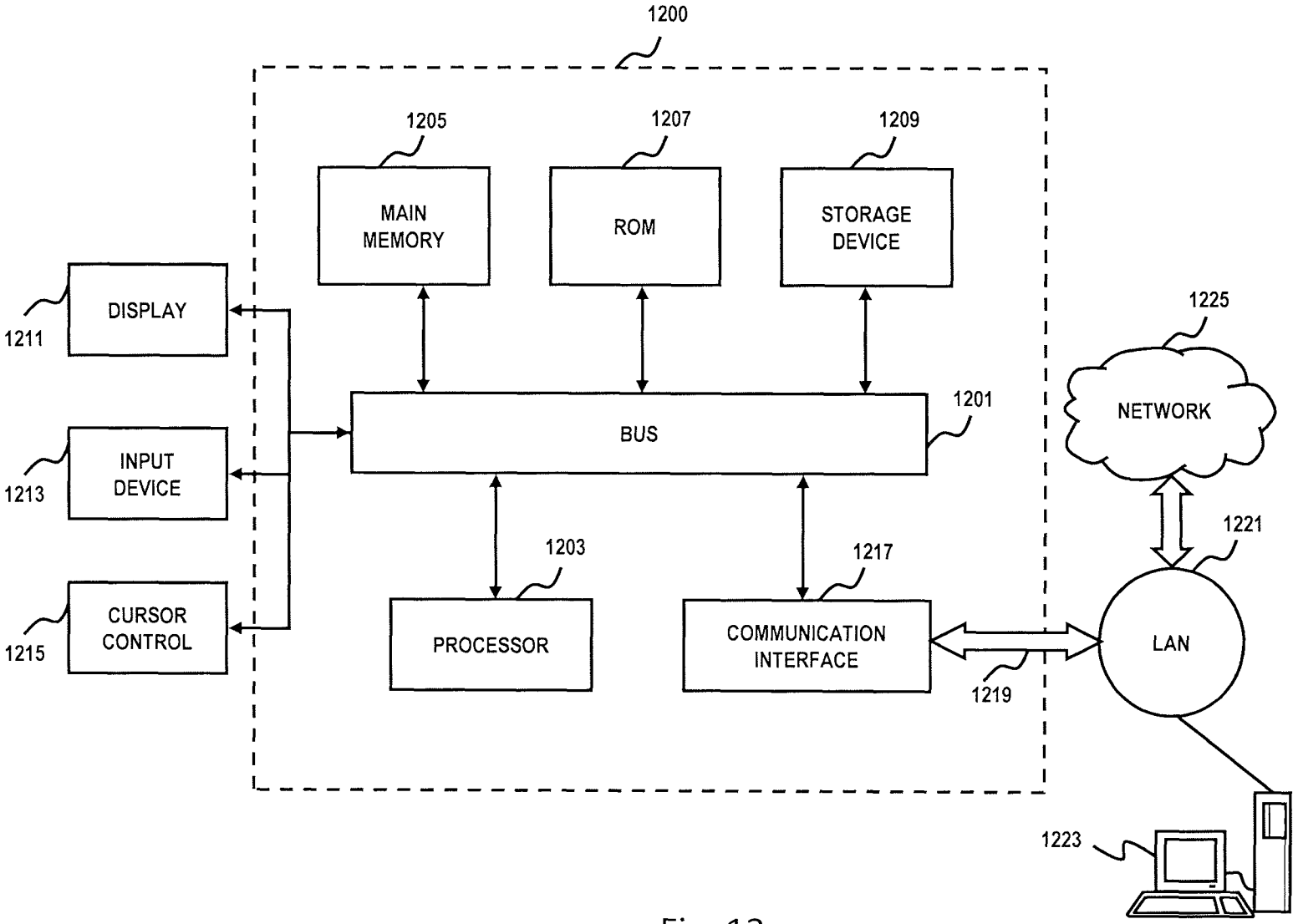
FIG. 12 is a diagram of a computer system that can be used to implement various exemplary features and embodiments.

FIG. 12 is a diagram of a computer system that can be used to implement features of various embodiments. The computer system 1200 includes a bus 1201 or other communication mechanism for communicating information and a processor 1203 coupled to the bus 1201 for processing information. The computer system 1200 also includes main memory 1205, such as a random access memory (RAM), dynamic random access memory (DRAM), synchronous dynamic random access memory (SDRAM), double data rate synchronous dynamic random-access memory (DDR SDRAM), DDR2 SDRAM, DDR3 SDRAM, DDR4 SDRAM, etc., or other dynamic storage device (e.g., flash RAM), coupled to the bus 1201 for storing information and instructions to be executed by the processor 1203. Main memory 1205 can also be used for storing temporary variables or other intermediate information during execution of instructions by the processor 1203. The computer system 1200 may further include a read only memory (ROM) 1207 or other static storage device coupled to the bus 1201 for storing static information and instructions for the processor 1203. A storage device 1209, such as a magnetic disk or optical disk, is coupled to the bus 1201 for persistently storing information and instructions.

The computer system 1200 may be coupled via the bus 1201 to a display 1211, such as a light emitting diode (LED) or other flat panel displays, for displaying information to a computer user. An input device 1213, such as a keyboard including alphanumeric and other keys, is coupled to the bus 1201 for communicating information and command selections to the processor 1203. Another type of user input device is a cursor control 1215, such as a mouse, a trackball, or cursor direction keys, for communicating direction information and command selections to the processor 1203 and for controlling cursor movement on the display 1211. Additionally, the display 1211 can be touch enabled (i.e., capacitive or resistive) in order facilitate user input via touch or gestures.

According to an exemplary embodiment, the processes described herein are performed by the computer system 1200, in response to the processor 1203 executing an arrangement of instructions contained in main memory 1205. Such instructions can be read into main memory 1205 from another computer-readable medium, such as the storage device 1209. Execution of the arrangement of instructions contained in main memory 1205 causes the processor 1203 to perform the process steps described herein. One or more processors in a multi-processing arrangement may also be employed to execute the instructions contained in main memory 1205. In alternative embodiments, hard-wired circuitry may be used in place of or in combination with software instructions to implement exemplary embodiments. Thus, exemplary embodiments are not limited to any specific combination of hardware circuitry and software.

The computer system 1200 also includes a communication interface 1217 coupled to bus 1201. The communication interface 1217 provides a two-way data communication coupling to a network link 1219 connected to a local network 1221. For example, the communication interface 1217 may be a digital subscriber line (DSL) card or modem, an integrated services digital network (ISDN) card, a cable modem, fiber optic service (FiOS) line, or any other communication interface to provide a data communication connection to a corresponding type of communication line. As another example, communication interface 1217 may be a local area network (LAN) card (e.g. for Ethernet™ or an Asynchronous Transfer Mode (ATM) network) to provide a data communication connection to a compatible LAN. Wireless links can also be implemented. In any such implementation, communication interface 1217 sends and receives electrical, electromagnetic, or optical signals that carry digital data streams representing various types of information. Further, the communication interface 1217 can include peripheral interface devices, such as a Universal Serial Bus (USB) interface, a High Definition Multimedia Interface (HDMI), etc. Although a single communication interface 1217 is depicted in FIG. 12, multiple communication interfaces can also be employed.

The network link 1219 typically provides data communication through one or more networks to other data devices. For example, the network link 1219 may provide a connection through local network 1221 to a host computer 1223, which has connectivity to a network 1225 such as a wide area network (WAN) or the Internet. The local network 1221 and the network 1225 both use electrical, electromagnetic, or optical signals to convey information and instructions. The signals through the various networks and the signals on the network link 1219 and through the communication interface 1217, which communicate digital data with the computer system 1200, are exemplary forms of carrier waves bearing the information and instructions.

The computer system 1200 can send messages and receive data, including program code, through the network(s), the network link 1219, and the communication interface 1217. In the Internet example, a server (not shown) might transmit requested code belonging to an application program for implementing an exemplary embodiment through the network 1225, the local network 1221 and the communication interface 1217. The processor 1203 may execute the transmitted code while being received and/or store the code in the storage device 1209, or other non-volatile storage for later execution. In this manner, the computer system 1200 may obtain application code in the form of a carrier wave.

The term "computer-readable medium" as used herein refers to any medium that participates in providing instructions to the processor 1203 for execution. Such a medium may take many forms, including but not limited to non-volatile media, volatile media, and transmission media. Non-volatile media include, for example, optical or magnetic disks, such as the storage device 1209. Non-volatile media can further include flash drives, USB drives, microSD cards, etc. Volatile media include dynamic memory, such as main memory 1205. Transmission media include coaxial cables, copper wire and fiber optics, including the wires that comprise the bus 1201. Transmission media can also take the form of acoustic, optical, or electromagnetic waves, such as those generated during radio frequency (RF) and infrared (IR) data communications. Common forms of computer-readable media include, for example, a USB drive, microSD card, hard disk drive, solid state drive, optical disk (e.g., DVD, DVD RW, Blu-ray), or any other medium from which a computer can read.

Figure 13:
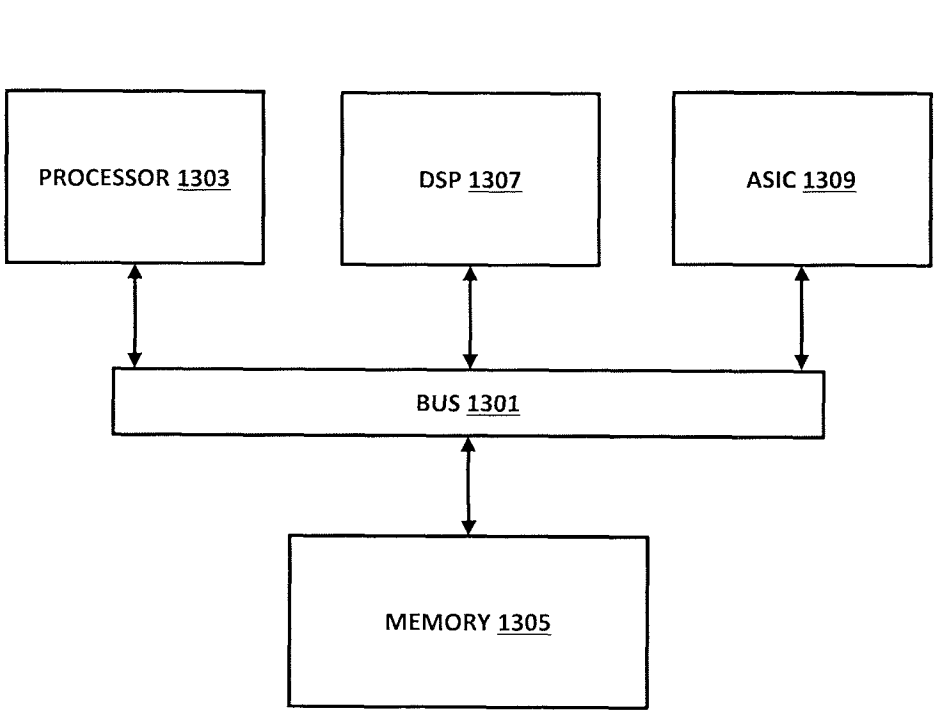
FIG. 13 is a diagram of a chip set that can be used to implement various exemplary features and embodiments.

FIG. 13 illustrates a chip set 1300 upon which features of various embodiments may be implemented. Chip set 1300 is programmed to implement various features as described herein and includes, for instance, the processor and memory components described with respect to FIG. 13 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip. Chip set 1300, or a portion thereof, constitutes a means for performing one or more steps of the figures.

In one embodiment, the chip set 1300 includes a communication mechanism such as a bus 1301 for passing information among the components of the chip set 1300. A processor 1303 has connectivity to the bus 1301 to execute instructions and process information stored in, for example, a memory 1305. The processor 1303 may include one or more processing cores with each core configured to perform independently. A multi-core processor enables multiprocessing within a single physical package. Examples of a multi-core processor include two, four, eight, or greater numbers of processing cores. Alternatively or in addition, the processor 1303 may include one or more microprocessors configured in tandem via the bus 1301 to enable independent execution of instructions, pipelining, and multithreading. The processor 1303 may also be accompanied with one or more specialized components to perform certain processing functions and tasks such as one or more digital signal processors (DSP) 1307, or one or more application-specific integrated circuits (ASIC) 1309. A DSP 1307 typically is configured to process real-world signals (e.g., sound) in real time independently of the processor 1303. Similarly, an ASIC 1309 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 1303 and accompanying components have connectivity to the memory 1305 via the bus 1301. The memory 1305 includes both dynamic memory (e.g., RAM, magnetic disk, re-writable optical disk, etc.) and static memory (e.g., ROM, CD-ROM, DVD, BLU-RAY disk, etc.) for storing executable instructions that when executed perform the inventive steps described herein to controlling a set-top box based on device events. The memory 1305 also stores the data associated with or generated by the execution of the inventive steps.

While certain exemplary embodiments and implementations have been described herein, other embodiments and modifications will be apparent from this description. Accordingly, the various embodiments described are not intended to be limiting, but rather are encompassed by the broader scope of the presented claims and various obvious modifications and equivalent arrangements.

What is claimed is:

1. A method comprising:

configuring a horn-type feed unit of a reflector antenna system to generate a first wave having a first polarization;

determining a polarization mismatch between the first polarization of the first wave generated by the feed unit and a second polarization associated with a reflector unit of the reflector antenna system;

pre-distorting the first wave to achieve a compensated polarization for reducing and/or eliminating the polarization mismatch by disposing a first pin through a first interior side of the feed unit, disposing a second pin through a second interior side of the feed unit, and exciting the first pin and the second pin to generate the first wave with the compensated polarization, and wherein the second interior side is orthogonal to the first interior side;

illuminating the reflector unit with the pre-distorted first wave having the compensated polarization;

reflecting, by the reflector unit, at least a re-radiated wave;

determining at least one property of one or more of the first wave, the pre-distorted first wave, the re-radiated wave, a scattered wave reflected by the reflector unit, and a specular wave reflected by the reflector unit; and adjusting the pre-distorting of the first wave based on the determined at least one property; and wherein a level of the re-radiated wave is increased as a result of the pre-distortion.

2. The method of claim 1, wherein exciting the first pin and the second pin comprises:

applying a first electric field having a predetermined amplitude and phase to the first pin; and applying a second electric field having a predetermined amplitude and phase to the second pin.

3. The method of claim 1, further comprising:

retrieving an axial ratio associated with the reflector unit; and pre-distorting the first polarization based, at least in part, on the retrieved axial ratio.

4. An apparatus comprising:

a horn-type feed unit, including a first pin disposed through a first interior side of the feed unit, and a second pin disposed through a second interior side of the feed unit, the second interior side being orthogonal to the first interior side;

a reflector unit;

a controller configured to excite the first pin and the second pin to generate the first wave having the compensated polarization; and one or more sensors; and wherein the feed unit is configured to generate a first wave having a first polarization, wherein the reflector unit is configured to reflect at least a re-radiated wave, wherein the re-radiated wave reflects a second polarization associated with the reflector unit, the second polarization being mismatched relative to the first polarization, wherein the feed unit is configured to pre-distort the first wave to achieve a compensated polarization for reducing and/or eliminating the polarization mismatch, and to output the pre-distorted first wave having the compensated polarization, wherein the one or more sensors is/are configured to determine at least one property of one or more of the first wave, the pre-distorted first wave, the re-radiated wave, a scattered wave reflected by the reflector unit, and a specular wave reflected by the reflector unit; and wherein the controller is configured to adjust the pre-distorting of the first wave based on the determined at least one property, and wherein a level of the re-radiated wave is increased as a result of the pre-distortion.

5. The apparatus of claim 4, wherein the controller is further configured to apply a first electric field having a predetermined amplitude and phase to the first pin; and apply a second electric field having a predetermined amplitude and phase to the second pin.

6. The apparatus of claim 4, wherein the feed unit is configured to determine the polarization mismatch based, at least in part, on an axial ratio associated with the reflector unit.

* * * * *